US006056610A

United States Patent [19]

Fontanille

[11] Patent Number: 6,056,610

[45] Date of Patent: May 2, 2000

[54] RETRACTABLE BOAT OR SHIP THRUSTER PROVIDED WITH MEANS FOR PREVENTING PIVOTING

[75] Inventor: Guy Fontanille, Les hauts de Pelicouet, 83600 Les Adrets, France

[73] Assignees: Guy Fontanille; Klara Skaaltveit, both of Les Adrets, France

[21] Appl. No.: 09/077,452

[22] PCT Filed: Nov. 28, 1996

[86] PCT No.: PCT/FR96/01885

§ 371 Date: Feb. 23, 1999

§ 102(e) Date: Feb. 23, 1999

[87] PCT Pub. No.: WO97/20733

PCT Pub. Date: Jun. 12, 1997

[30] Foreign Application Priority Data

Dec. 1, 1995 [FR] France ..... 95 14806

[51] Int. Cl.[7] ..... B63H 5/125

[52] U.S. Cl. ..... 440/54

[58] Field of Search ..... 440/54; 114/151

[56] References Cited

U.S. PATENT DOCUMENTS

| | | | |
|---|---|---|---|
| 2,156,938 | 5/1939 | Edwards | 115/35 |
| 2,302,795 | 11/1942 | Noble | 440/54 |
| 2,987,027 | 6/1961 | Wanzer | 440/54 |
| 3,483,843 | 12/1969 | Hawthorne . | |
| 3,807,347 | 4/1974 | Baldwin | 115/41 |
| 4,226,206 | 10/1980 | Wilson | 440/112 |
| 4,464,128 | 8/1984 | Aso et al. | 440/112 |
| 5,522,744 | 6/1996 | Scholgel | 440/54 |

FOREIGN PATENT DOCUMENTS 832 537 9/1938 France .

OTHER PUBLICATIONS

International Search Report PCT/FR96/01885.

*Primary Examiner*—Sherman Basinger
*Attorney, Agent, or Firm*—Wolf, Greenfield & Sacks, P.C.

[57] ABSTRACT

The present invention relates to a transverse or longitudinal thruster made for a floating or submersible vessel. The thruster includes a male part extending transversely to the axis ZZ' and of shape complementary to a female shape of a well having a longitudinal shape. The male part is attached to a maneuvering support arm of a cylindrical shape, and is arranged to slide longitudinally inside the well along its axis. The support arm passes through a guide bearing to the well with a clearance $\Delta_1$ between their respective complementary shapes. The clearance $\Delta_1$ is compatible with a clearance $\Delta_2$, obtained between the transverse male part and the edge of the well, where it joins the hull when the thruster is in the extended position. The clearances $\Delta_1$ and $\Delta_2$ are arranged to enable the male part to bear against the edge of the well to transmit thrust forces created by the thruster to the hull of the vessel.

17 Claims, 3 Drawing Sheets

RETRACTABLE BOAT OR SHIP THRUSTER PROVIDED WITH MEANS FOR PREVENTING PIVOTING

RELATED ART

This application claims priority from the PCT application PCT/FR96/01885 filed on Nov. 28, 1996, which in turn claims priority from the French application FR95/14806 filed on Dec. 1, 1995.

BACKGROUND

Field of the Invention

The present invention relates to a thruster which is retractable into the hull of a floating or submersible vessel. The thruster is particularly advantageous for fitting to the stem or the bow of a boat or a ship.

The state of the art is constituted by numerous documents, and the most pertinent known to the Applicant are the following.

The Applicant's document EP-A-0 503 206 relates to a retractable or extendable thruster using a trapezoidal device that deforms on being pivoted, thereby generating rectilinear movement inside a well. The thruster is retractable or extendable and is made up of a box fixed in leakproof manner via joint planes to a well that is an integral portion of the structure of the vessel. Two asymmetric pivot arms are folded inside the box, together with a motor-driven base unit, a bracket, and a helical assembly. The two arms are hinged firstly to the box and secondly to the bracket which is secured to the thrust base unit. Under manual or mechanical drive exerted on a lever secured to one of the arms by the shaft, said atm pivots together with the other or "triangulation" arm and controls deformation of the trapezium, thereby obtaining rectilinear movement of the base at the center thereof.

Although technically most effective, the cost of manufacturing such a thruster is prohibitive.

The number of moving parts and the design of the linkage they form increase the sale price of the thruster considerably.

Document FR-A-2 229 608 proposes a motor, e.g. a hydraulic motor, which drives a vertical or sloping shaft having two pieces capable of sliding one relative to the other. The lower portion of the shaft drives a propeller via angle gearing. Because of the slidable drive shaft, the propeller can be retracted and raised above the waterline. This sliding can be driven by a hydraulic actuator controlled with the same oil under pressure as drives the hydraulic motor. The propeller may be steerable to steer the boat. In its high position, retracted into a well provided for this purpose, the raisable portion can close said well so as to restore full hydrodynamic performance to the hull of the boat.

The essential problem with that device lies in the fact that the thruster is steerable. In the most advantageous embodiment, that kind of thruster is used for moving the stem of a ship substantially perpendicularly to the longitudinal axis of the ship. Since such movement is always along the same direction, the steering angle must be constant. In addition, having a steerable thruster increases the financial costs associated with designing and building that type of device, and therefore increases the sale cost thereof.

Document FR-A-2 348 850 deals with a device for locking a retractable thruster for a boat: locking takes place by means of four hinged and inclined latches producing thrust with both vertical and horizontal components, and four hinged latches producing horizontal thrust. The invention applies to large thrusters that are vertically retractable into a very large housing in a boat, which housing receives a moving box carrying the thruster assembly, with the thrust forces therefrom being transmitted to the boat by the entire structure for guiding the box. That device for locking a boat thruster acts both vertically and horizontally. Its structure is complex and therefore expensive, with four latches hating orientations that are specific, thus requiring the latches to be capable of withstanding thrust forces.

SUMMARY

The present invention is simple, low cost, and comprises firstly a function enabling thrust forces to be taken up by the hull without requiring a complex mechanical element that needs to withstand large stresses and/or be well fitted, and secondly a function that prevents the thruster from pivoting relative to the boat or ship that uses it.

The invention provides a transverse or longitudinal thruster associated with means for moving it in and out of a "retraction" well of longitudinal shape that is present in the hull of a floating or submersible vessel and that includes means for preventing pivoting about the longitudinal axis ZZ' of the well; said thruster including a male part extending transversely to the axis ZZ' and of any shape that is complementary to the female shape of the inside of said well in which it slides longitudinally along said axis, and a maneuvering support arm that can be described as a sliding or translating column, of cylindrical shape about the same axis and passing through a guide bearing secured to said well with clearance $\Delta_1$ between the respective complementary shapes thereof that is compatible with the clearance $\Delta_2$ obtained when the thruster is in the extended position between said transverse male part and the edge of the well joining it to the hull, thereby enabling said male part to bear against the hull.

In a particular embodiment, the male part and the female shape of the inside of the well are polygonal in cross-section, and also constitute said means for preventing the thruster from pivoting about the longitudinal axis ZZ' of the well.

In another embodiment, said male part and the inside of the well are circular in shape: in which case, said means for preventing pivoting are constituted either by the longitudinal axis ZZ' of the well and the longitudinal axis of the guide arm being offset from each other, or by a female or male guide rail formed or fixed longitudinally on or to the inside wall of the well with said male part that slides therein including an appendix or a notch respectively compatible with the shape of the rail; said rail may even be interrupted at its end before the edge of the well and the male part, on being lowered a little further than the rail, can be disengaged therefrom while continuing to'be guided in the well, thus making it possible, where necessary, for it to pivot freely when in this position.

In a preferred embodiment, said well is closed at its top end by a closure plate that is leakproof relative to the side walls of the well and that carries said bearing, which bearing includes a sealing lip gasket engaging the arm and allowing said clearance $\Delta_1$ between them.

The result is a novel type of transverse or longitudinal thruster which is simple to implement, which is of low cost, and which provides the above-defined is functions concerning no support in the form of a fitted and complicated intermediate mechanism whether for transmitting thrust to the hull of the ship or for preventing pivoting; with these two functions being capable of being performed by the same means that also serve to guide the thruster in its retraction well.

In the present invention, the existence of the two above-defined clearances which are described in greater detail below makes it possible for the structure to be very light in weight while still performing the above functions, whereas in the prior art, the thruster is cantilevered out at the end of a support structure which is received in and carried by a guide system, thus presenting a considerable lever arm, with the entire assembly needing to be capable of withstanding a large bending moment caused by the thrust from the thruster; thus, in prior art structures, there are to be found fitted mechanical systems without clearance, that are expensive and that need to be of considerable strength, particularly when the height over which the parts are mutually engaged is relatively small compared with the lever arm having the thruster mounted at its end. In contrast, in the present invention, not only is thrust taken up directly by the hull, the other bearing point that is necessary at the bearing to oppose tilting of the thruster support arm needs to withstand a force that is smaller than the thrust from the thruster by a factor determined by the ratio of the lever arms about the point where the male part bears against the hull, thereby making it possible to lighten the structure.

In addition, the existence of such clearances between the moving parts and the fixed parts of the apparatus reduces the risk of jamming.

In the present invention, the well into which said thruster is retracted can be made completely watertight from the remainder of the surrounding hull, thereby allowing it to be installed even below the waterline/or in a submersible vessel.

Other advantages of the present invention could also be mentioned, however those mentioned above already suffice for demonstrating the novelty and the utility of the invention.

It may be observed that such apparatus of the invention is well adapted to thrusters of relatively low power enabling them to be used on small watercraft, in particular pleasure craft, where the thruster needs to be installed well forward in the stem of the boat, without taking up space in the cabin portion; in addition, because cost price is relatively low, due to the characteristics of the present invention, it does not make such craft much more expensive; high power thrusters can also be envisaged for large floating units, in which case additional precautions need to be taken by the person skilled in the art to accommodate the shocks that are due to the mechanical clearance deliberately provided by the invention and which will then be large.

The accompanying drawings are given as non-limiting examples. They show various preferred embodiments of the invention. They enable the invention to be understood but they are not limiting in any way: other embodiments are possible in the ambit of the scope and the extent of this invention, in particular by changing the cross-sectional shape of the male part and the female shape of the well in which it slides:

DETAILED DESCRIPTION

Figure 1:
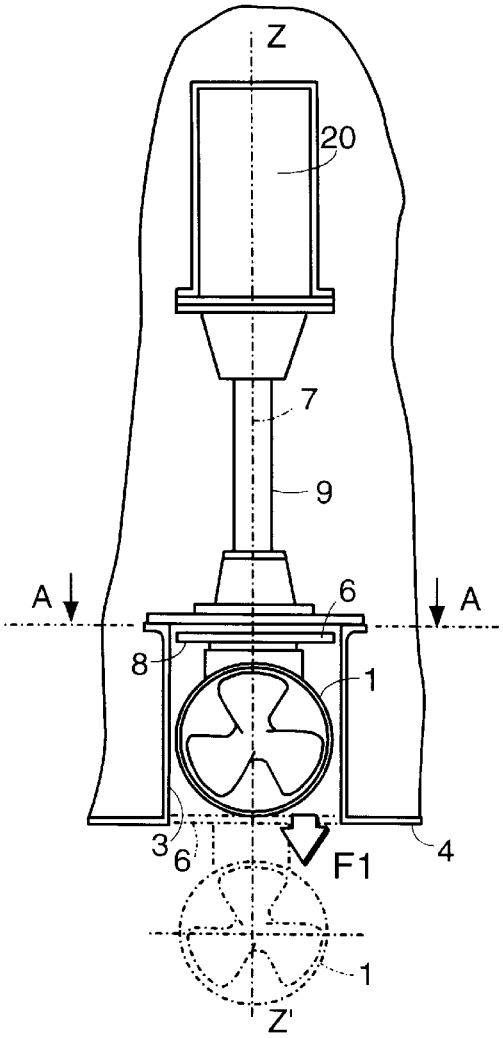
FIG. 1 is a longitudinal section view of a well in the hull of a boat, also showing a thruster and a guide arm.

The present invention relates to a thruster 1 designed to be moved longitudinally along an axis ZZ' of a well 3 by means 2 for moving it in and out.

The well 3 is formed in the hull 4 of a floating or submersible vessel: it opens out in the bottom thereof and its axis ZZ' is then vertical.

The thruster 1 is designed to impart lateral or longitudinal movement to the stem of a boat, a ship, a submarine, etc.

Nevertheless, it may be located at the bow and/or the stern.

The longitudinal axis YY' of the tunnel 19 in which the propeller 18 is placed extends transversely, i.e. perpendicularly to the longitudinal axis XX' of the floating or submersible vessel; and the axis ZZ' of the well 3 which is vertical in this case is perpendicular to both of said axes.

Figure 2:
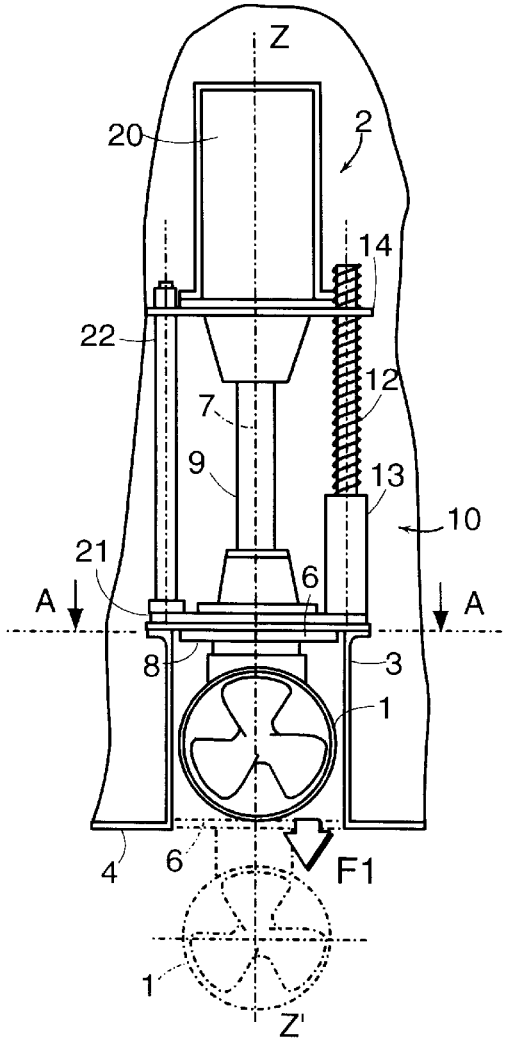
FIG. 2 is a section view identical to FIG. 1, but showing in addition to the thruster and the guide arm, a first embodiment of means for moving said thruster in and out.
Figure 4:
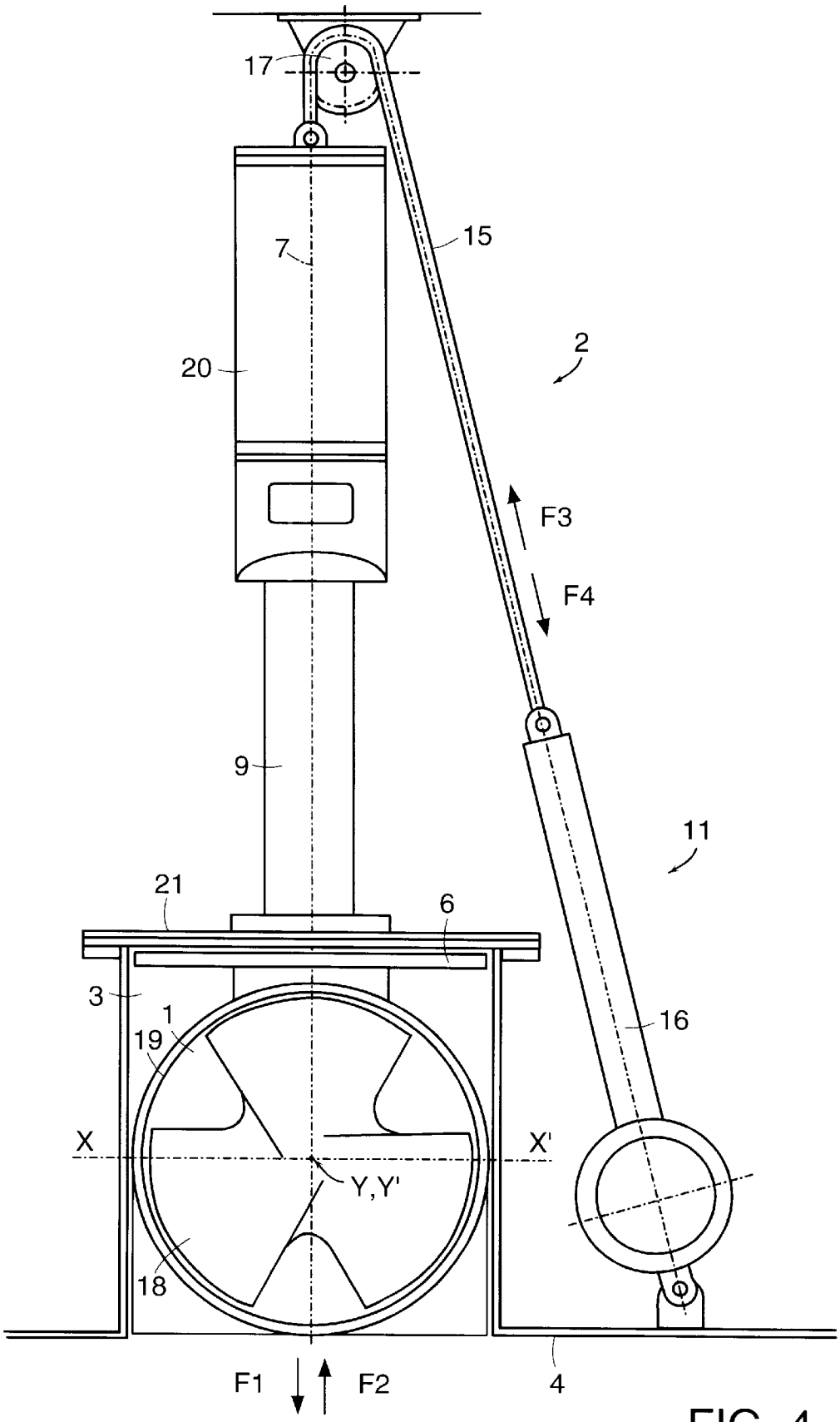
FIG. 4 is a section view identical to FIG. 2, but showing a second embodiment of the means for moving the thruster in and out.
Figure 5:
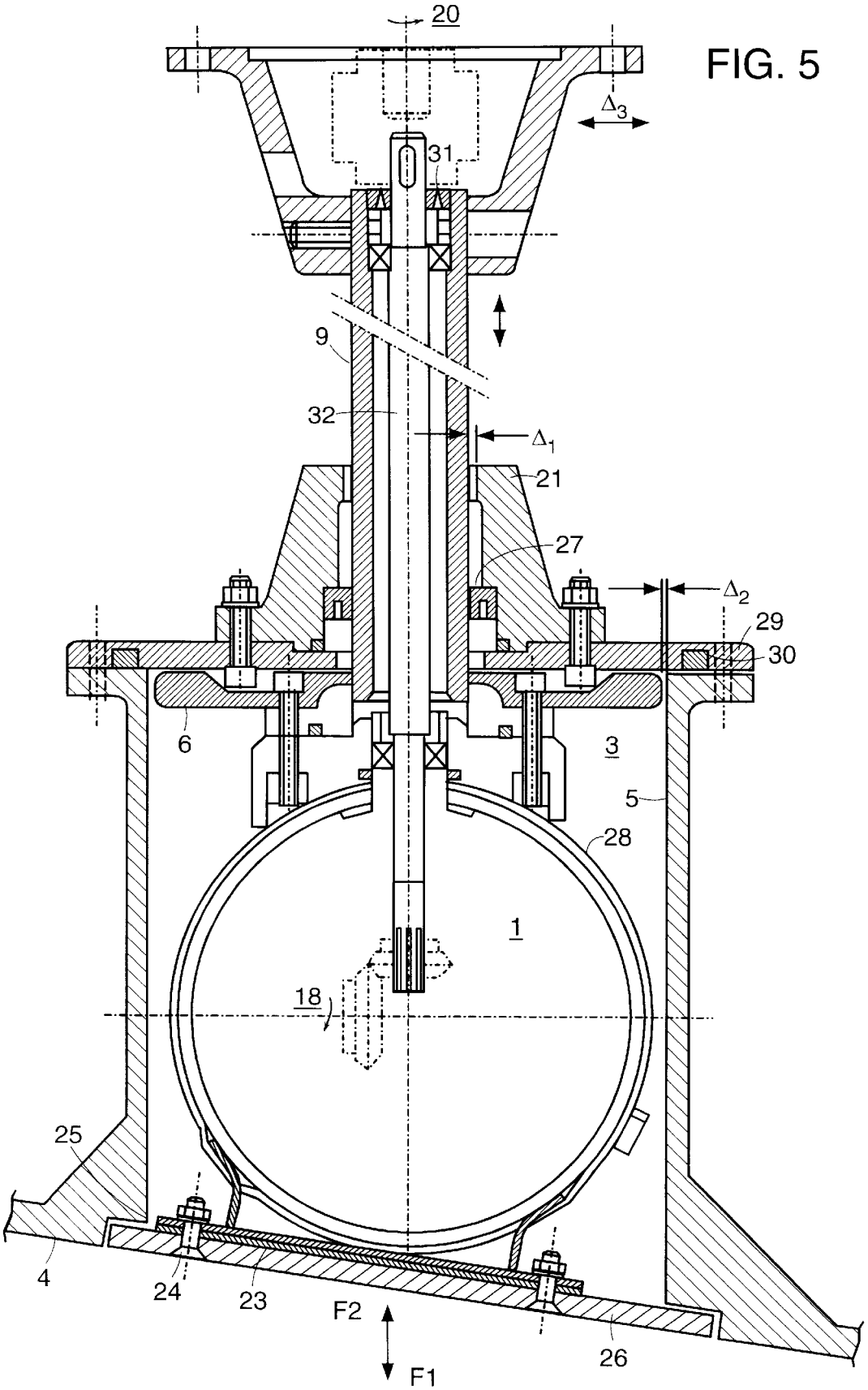
FIG. 5 is a view of the bottom portion of the FIG. 1 device, and in which specific characteristics for implementing the invention are shown.

The thruster 1 is associated with a guide arm 9 which includes at its upper end drive means 20 for rotating said propeller 18 via a shaft 32 that rotates inside said arm 9 and, at its other end, drives angle gearing as shown in chain-dotted lines in FIG. 5, since the angle is normally in a plane perpendicular to the figure so that the axis of the propeller 18 lies in the axis of the tunnel 19 containing it, as shown in FIGS. 1 and 2. In other embodiments, the transmission may be hydraulic or electric, and thus without angle gearing or a shaft 32. It is the entire assembly constituted by the arm 9 and the thruster 1 which is movable along F1 to enable said thruster to be moved out from the well 3 and from the hull, as is clearly shown in FIGS. 1, 2, 4, and 5.

In the opposite direction along F2, as shown in FIGS. 4 and 5, the assembly comprising the thruster 1 and the arm 9 can be raised and retracted into the well 3, with the advantage being that the thruster 1 in the inside position does not project from the plane of the hull 4.

In a particular embodiment, a plug 26 as shown in FIG. 5 can be present at the free end of the assembly constituted by the thruster 1 and the arm 9, such that when the thruster is in its inside position, the plug 26 forms a continuous surface with the adjacent hull 4, thereby conserving the hydrodynamic properties of the hull 4. This closure plug 26 can be adapted to a hull 4 of any shape, being fixed on request and adjusted in position relative to the tunnel 19, e.g. by means of collars 28: the collars hold an intermediate plate 23 to which the plug 26 is applied, e.g. by bolts 24.

In other embodiments, the propeller 18 need not be faired in a tunnel: under such circumstances, the closure plug 26 can be fixed on a bottom foot of the thrust support column.

The essential feature of the invention lies in the fact that a "male" part 6 extending transversely to the axis ZZ' and complementary in shape to the female shape 5 of the well 3 slides longitudinally in the well along said axis, and that a support arm 9 for maneuvering the thruster is cylindrical in shape about the same axis and passes through a guide bearing 21 secured to the well 3 while leaving clearance $\Delta_1$ between their respective complementary shapes, which clearance is compatible with the clearance $\Delta_2$ obtained in the extended position of the thruster 1 between said transverse male part 6 and the rim 25 of the well 3 where it joins the hull 4, thus enabling the male part 6 to bear thereagainst.

The thickness of this male part 6 is not limited and depends on requirements, and the main function of the part 6 is taking up the thrust forces from the thruster 1 by bearing directly against said rim 25 level with the outside wall of the structure of the hull 4, thereby transmitting all of the thrust directly thereto.

In the accompanying figures, said male part 6 is a plate located between the thruster 1 and the means 2 for moving said thruster 1 in and out, i.e. between the thruster 1 and the arm 9.

Figure 3:
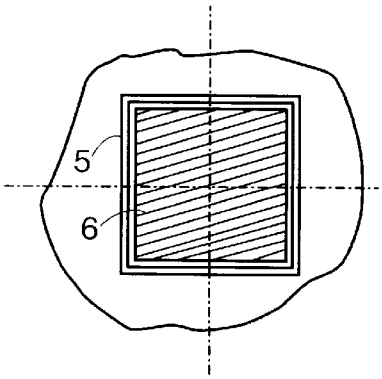
FIG. 3 is a cross-section view on A—A of FIG. 1 or FIG. 2.
Figure 3A:
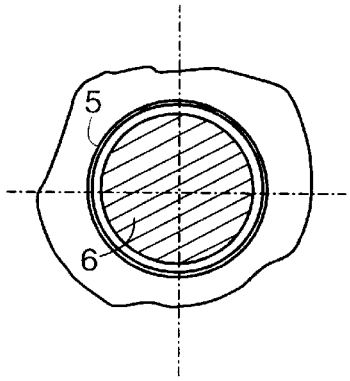
FIG. 3A is a cross-section view similar to FIG. 3 but showing a different embodiment.

This male part 6 and the female shape 5 of the wall 3 may be polygonal in cross-sectional shape, for example it may be square in section as shown in FIG. 3, in which case it also constitutes the said means for preventing the thruster from pivoting about the longitudinal axis ZZ' of the well 3, and thus relative to the hull 4. In addition, said part 6 and the complementary female shape 5 of the well 3 act as guide means for guiding the thruster 1 as it moves while it is being retracted or extended relative to said well 3.

To achieve this result, and as mentioned above, the part 6 may be square in section and be received inside a similarly square female shape 5 of the well 3; naturally, the square 5 of the well 3 is a recess of dimensions slightly greater that the dimensions of the part 6: thus, for example, the desired clearance $\Delta_2$ between these shapes 5 and 6, whether they are square or otherwise, is at least one part in a thousand, and at the most that which is allowed by the clearance $\Delta_1$ allowed in the bearing 21 between the outside shape of the arm 9 and the complementary inside shape of said bearing 21.

Said well 3 is preferably closed at its top end by a closure plate 29 which is fitted in leakproof manner to the side walls 5 of the well and which carries said bearing 21. The bearing then includes a sealing lip gasket 27 engaging the arm 9 and making said clearance $\Delta_1$ possible, as can be seen in FIG. 5. To ensure that the inside of the well 3 is completely leakproof and that the entire thruster device can be located beneath the waterline of the floating vessel, or in a submersible vessel, the top plate 29 for closing the well 3 also includes at its periphery any appropriate sealing device such as an O-ring type gasket 30 bearing against the top rim remote from the rim 25 of the well 3, and the propeller drive shaft 32 inside the arm 9 is also sealed, e.g. by means of a lip type gasket 31 preferably situated at the top of said arm 9.

All of the other fixing parts that pass through the wall defining the volume in which the thruster 1 is thus retractable, such as the bolts for assembling the beating 21 to the closure plate 29, may also be provided with O-rings or other sealing devices.

Because of the above-defined clearances $\Delta_1$ and $\Delta_2$, the drive means 20 for driving the propeller 18 as mounted at the opposite end of the arm 9 therefrom will be subjected to swinging displacement of amplitude $\Delta_3$. This displacement is accommodated by the means for driving the thruster longitudinally along the axis ZZ, as described below.

When the thruster 1 is in its extended position along F1, the outside face 8 of the male part, which may be a plate 6, is situated adjacent to the thruster and may, in a particular embodiment, lie in the plane of the hull 4 so as to be coplanar with the adjacent faces thereof, such that no disturbance can penetrate into the inside of the well 3 which is isolated by means of the plate 6, likewise for conserving the hydrodynamic properties of the hull 4.

In addition, in embodiments having no tunnel 19, the plate 6 performs an anticavitation function relative to the propeller 18.

In other embodiments, the engagement of the male part 6 and the female shape 5 of the well 3 can be of any polygonal shape, and can even be circular, while maintaining between them said clearance $\Delta_2$ to allow thrust forces to be taken up directly by the hull 4 when the thruster is in the extended position; if the shapes are circular, pivoting forces, which are smaller than direct thrust forces, can be taken up, e.g. by having the axis 7 of the arm 9 off-center relative to the axis ZZ' of the well 3.

Drive for moving the assembly comprising the arm 9 and the thruster 1 along said axis ZZ' can be provided in various ways.

Embodiments are described below, but others are also possible, such as manual systems or mechanical drive by means of actuators or screws extending in any direction depending on the point at which they are fixed to the supporting hull and acting via deflector means, as shown in the example of FIG. 4.

In FIG. 2, this drive 10 is constituted by a screw 12 rotated by a motor 13, the screw 12 co-operating with a nut 14 secured to the arm 9. Rotating the screw 12 thus enables the nut 14, and hence the assembly comprising the arm 9 and the thruster 1, to move along arrow F1 or F2. To further improve displacement of said assembly, guide columns 22 may be present as shown ir FIG. 2; two electric actuators may also be mounted diametrically opposite about the axis 7 of the arm 9 to operate synchronously, with the clearance that exists between the male part 6 and the female shape 5 of the well 3 accommodating possible offset, as mentioned above.

In FIG. 4,. the means 2 for moving the assembly in and out are constituted by another type of mechanical drive 11 for applying maneuvering drive to the arm 9. This mechanical drive comprises a traction line which may be a chain or a cable 15, which is moved along arrow F3 to move the thruster 1 out along arrow F1, and along F4 to enable it to be moved in along arrow F2, and it is driven longitudinally by means of an actuator 16 secured to the hull 4: one of the ends of the chain 15 is connected to the actuator 16 while its other end is connected to the other end of the arm 9.

To minimize the space occupied by the entire structure, a deflection pulley 17 is located between the actuator 16 and the arm 9, substantially on the longitudinal axis of the well 3 and of the arm 9. The pulley enables the chain to be deflected through an angle such that the two portions of the chain situated on either side of the pulley are at an angle which is preferably less than 20°, and even 15° as shown in FIG. 4, thus enabling the well 3 and the actuator 16 to be as close together as possible on the hull 4, such that the volume occupied by the thruster 1 and its auxiliary equipment 2, 3, 10, and 11 is as small as possible and as concentrated as possible close to said hull 4.

What is claimed is:

1. A transverse or longitudinal thruster for a floating or submersible vessel, associated with means for moving the thruster in and out of a well of longitudinal shape and including means for preventing pivoting about the longitudinal axis ZZ' of the well, comprising a male part extending transversely of axis ZZ' and of a shape complementary to the female shape of the inside of the well in which it slides longitudinally along said axis, and a maneuvering support arm of a cylindrical shape passing through a bearing secured to said well and having a propeller drive shaft rotatably mounted therein, said male part comprising a plate supported by said maneuvering support arm, said support arm supporting at its top end drive means for driving said shaft, the complementary shapes respectively of the bearing and of the support arm serving to guide the support arm with clearance $\Delta_1$, between them, which clearance is compatible with a clearance $\Delta_2$ obtained, when the thruster is in an extended position, between said transverse male part and an edge of the well, thereby enabling the male part to bear against the edge of the well and to transmit thrust forces to a hull of the vessel.

2. A thruster according to claim 1, wherein said male part and the female shape of the well are polygonal in cross-section.

3. A thruster according to claim 2, wherein the well is of a square cross-section and the male part is of complementary square shape arranged to guide the thruster.

4. A thruster according to claim 1, wherein a face of the plate which is situated adjacent to the thruster lies in a plane of the hull when said thruster is in the extended position.

5. A thruster according to claim 1, wherein the means for moving the thruster in and out comprise a motorized drive mechanism for imparting maneuvering drive to the support arm, the support arm moving the thruster between the extended position and a retracted position.

6. A thruster according to claim 5, wherein the motorized drive mechanism comprises at least one traction line driven longitudinally by an actuator secured to the hull, one of the free ends of the line being secured to the actuator and its other end to the arm.

7. A thruster according to claim 6, wherein a pulley for deflecting the traction line is present between the actuator and the arm, and the angle between the two portions of the traction line situated on either side of the pulley is less than 20° such that a volume of the thruster together with associated auxiliary equipment is as small as possible and is situated as close as possible to the hull.

8. A thruster according to claim 1, wherein the well is closed at its top end by a closure plate which is leakproof relative to side walls of the well and which carries said bearing, said bearing including a sealing lip gasket engaging the support arm and allowing said clearance $\Delta_1$.

9. A thruster according to claim 1, further comprising a plug mounted at a free end of an assembly constituted by the thruster and the arm and arranged to form a continuous surface with a surface of the adjacent hull for the thruster located in a retracted position.

10. A transverse or longitudinal thruster arranged to prevent pivoting in a floating or submersible vessel comprising:

a support arm constructed to support a thruster of a vessel and arranged to include a propeller drive shaft rotatably mounted therein;

a well extending inside from a hull of said vessel;

a male part connected to said support arm and arranged to move within said well between a retracted position of said thruster and an extended position of said thruster;

a guide bearing secured to said well and having an inner surface constructed to guide said support arm during the movement of said male part within said well, said inner surface of said guide bearing having a shape complimentary to an outer surface of said support arm with a clearance $\Delta_1$ when said thruster assumes said extended position; and a rim located at said well and said hull and having a selected inner surface, said selected inner surface of said rim being complementary to an outer surface of said male part and having a clearance $\Delta_2$ between said inner surface of said rim and said outer surface of said male part located in said extended position, wherein said clearances $\Delta_1$ and $\Delta_2$ are designed to enable said male part to bear against said rim of said well so that thrust forces created by said thruster are taken by said hull of said vessel.

11. The thruster according to claim 10, wherein said male part includes a plate.

12. The thruster according to claim 10, wherein a inside shape of said well and said male part have a polygonal cross-section.

13. The thruster according to claim 10, wherein a inside shape of said well and said male part have a square cross-section.

14. The thruster according to claim 10, wherein a inside shape of said well and said male part have a circular cross-section.

15. The thruster according to claim 10, wherein said inner surface of said guide bearing and said outer surface of said support arm have a circular cross-section.

16. The thruster according to claim 10, wherein said inner surface of said guide bearing includes a gasket arranged to allow said clearance $\Delta_1$.

17. The thruster according to claim 10, wherein said clearances $\Delta_1$ and $\Delta_2$ are one part in a thousand.

* * * * *